United States Patent [19]

Guiler

[11] 4,229,031

[45] Oct. 21, 1980

[54] SEAL

[75] Inventor: Richard S. Guiler, Stewartsville, N.J.

[73] Assignee: E. J. Brooks Company, Newark, N.J.

[21] Appl. No.: 38,325

[22] Filed: May 11, 1979

[51] Int. Cl.[3] ..... B65D 33/34

[52] U.S. Cl. ..... 292/322

[58] Field of Search ..... 292/307, 316, 317, 318, 292/319, 320, 221, 322; 24/16 PB

[56] References Cited

U.S. PATENT DOCUMENTS

| | | | |
|---|---|---|---|
| 998,878 | 7/1911 | Dinsmoor | 292/320 |
| 3,466,077 | 9/1969 | Moberg | 292/322 |
| 3,717,369 | 2/1973 | Stoffel et al. | 292/322 X |
| 3,854,482 | 12/1974 | Laugherty et al. | 292/322 X |
| 3,954,294 | 5/1976 | Iwamoto et al. | 292/318 |

FOREIGN PATENT DOCUMENTS

| | | | |
|---|---|---|---|
| 2342681 | 3/1974 | Fed. Rep. of Germany | 292/320 |

*Primary Examiner*—Richard E. Moore

*Attorney, Agent, or Firm*—Robert E. Ross

[57] ABSTRACT

A seal of the type having a hollow housing with internal resilient fingers for receiving a shouldered stud of a shackle into one end of the housing into locking engagement with the fingers, in which the opposite end is closed by a plug having resilient legs snapped into engagement with an internal recess in said opposite end. In one embodiment of the invention, the seal is formed of a single piece of molded plastic, with the plug being molded alongside the housing and being attached thereto by a flexible hinge or web.

In another embodiment of the invention, the end of the shackle beyond the shoulder projects into a cavity between the resilient legs to lock said legs into the internal recess.

7 Claims, 5 Drawing Figures

SEAL

BACKGROUND OF THE INVENTION

There is a continuing need for improved security seals that are economical to manufacture, that are easy to use, and that provide effective security. A number of seals are known which are formed of molded plastic, comprising a hollow body having internal flexible fingers, to receive a shouldered stud, inserted into one end of the housing, in locking engagement. One of the disadvantages of such seals is the fact that to mold the seal of a single piece of plastic, the other end of the housing must be open to allow retracting of the core pin forming the housing opening and the flexible fingers. If this end of the housing is left open when the seal is used, it is possible to open the seal by inserting a suitable tool into the open end to disengage the fingers from the shoulder of the stud.

Various means have been used to close the housing. In U.S. Pat. No. 3,466,077 issued Sept. 9, 1969 to S. M. Moberg and assigned to the same assignee as the present application, there is illustrated a seal in which the end of the housing is formed into a close dome by heated dies. Although the seal disclosed therein has achieved considerable commercial success, the somewhat complicated machinery required for the closing of the end of the housing reduces the production rate, with corresponding increase in cost. Also, such closing machinery is not readily adaptable to seals of other configurations, and new closing machinery would have to be build for each type of seal.

SUMMARY OF THE INVENTION

The invention disclosed herein comprises a seal having a shackle with a locking shoulder near the free end thereof, and a hollow socket having internal resilient fingers for receiving the shoulder of the shackle in locking engagement when the end of the shackle is inserted into one end of the socket. The other open end of the socket is provided with an internal circumferential groove, and a plug is provided to close said other end. The plug has a base of a size and shape that will completely cover said other socket opening, and has resilient legs with peripheral shoulders on the ends positioned to snap into engagement in the circumferential groove. In a preferred embodiment of the invention the extreme end of the assembled shackle projects into a cavity between the resilient legs to lock them into the groove, so that they cannot be removed without destroying some portion of the device.

In a preferred embodiment of the device, the plug is molded integrally with the seal, in a position adjacent the housing, and connected thereto by a flexible web, so that after molding, the plug can be pivoted on the web and inserted into the housing.

DESCRIPTION OF THE ILLUSTRATED EMBODIMENT

Figure 1:
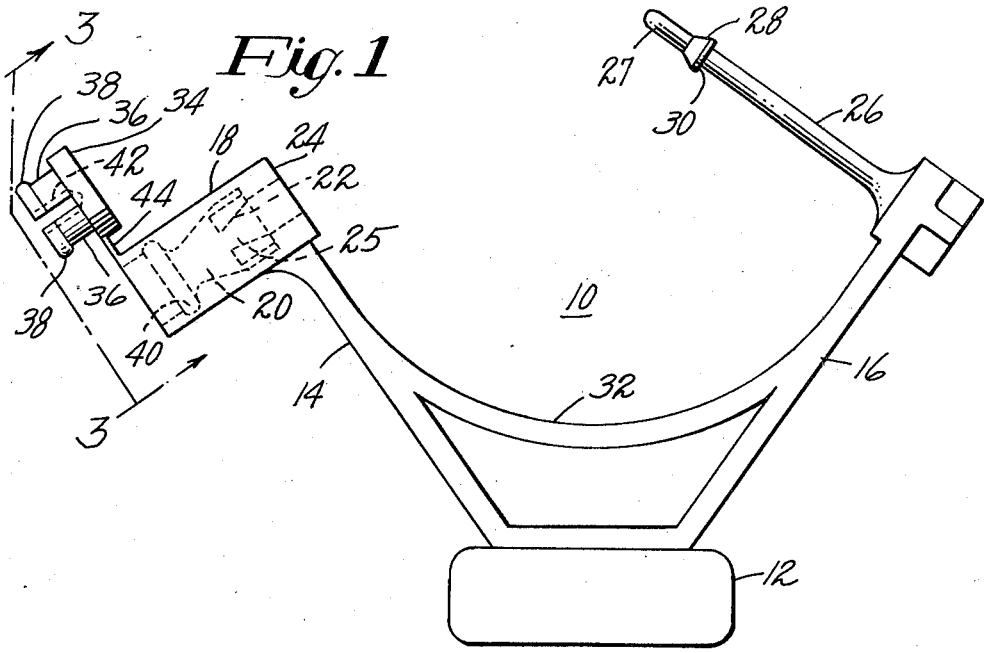
FIG. 1 is a view in elevation of a seal embodying the features of the invention, the seal being in the as molded condition.
Figure 2:
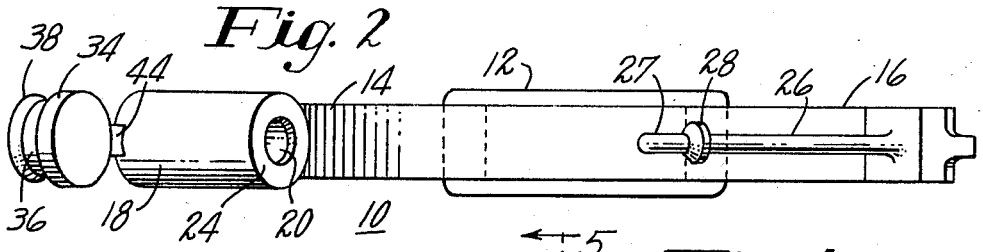
FIG. 2 is a view of the seal of FIG. 1 as seen from the top.
Figure 3:
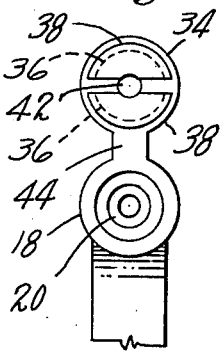
FIG. 3 is a view taken on line 3—3 of FIG. 1.
Figure 4:
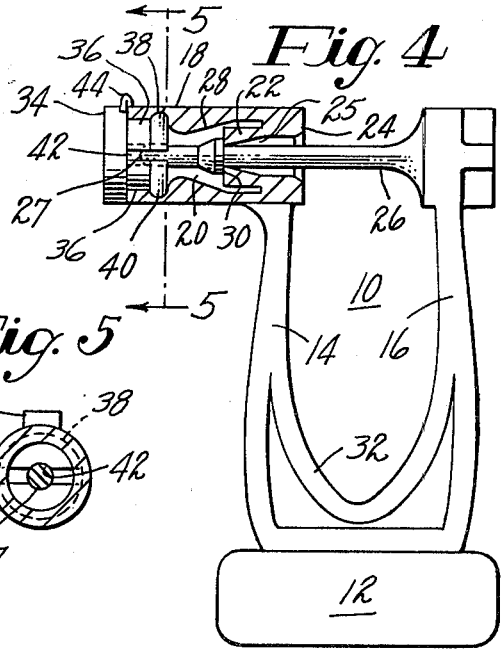
FIG. 4 is a view in elevation, partly in section, of the seal of FIG. 1 in which the housing plug has been assembled and the seal has been closed.
Figure 5:
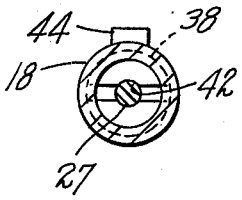
FIG. 5 is a sectional view taken on line 5—5 of FIG. 4.

Referring to the drawing, there is illustrated a seal 10, which comprises a base portion 12 and a pair of flexible legs 14 and 16 extending upwardly from the base and diverging from each other.

Disposed on the remote end of the leg 14 is a housing 18 which is open at each end with an internal cavity 20, the axis of which is substantially perpendicular to the direction of leg 14.

Disposed within the cavity 20 are a plurality of flexible fingers 22 which are recessed inside the front end 24 of the housing, and extend away from the opening at said front end, forming a socket 25.

Disposed on the remote end of the leg 16 is an elongated stud 26 which extends generally in a direction perpendicular to the direction of the leg 16, and is provided with an enlarged head 28 positioned rearwardly from the extreme end 27, said enlarged head having a rearwardly facing shoulder 30.

The parts of the device are so positioned and dimensioned that when the two legs 14 and 16 are squeezed together, the end of the stud 26 will enter the socket 25 of the housing by way of the front end of the housing so that the head 28 passes between the flexible fingers 22 and the fingers snap behind the shoulder 30.

The seal as described above is described and claimed in a co-pending application Ser. No. 38,334, filed May, 11, 1979 by Sigurd M. Moberg and assigned to the same assignee as this application, and is shown in this application as merely one seal configuration with which the invention of this application can be utilized.

To prevent access to the locking fingers 22, the rear end of the housing may be closed by a plug 34 having resilient locking legs 36 with external shoulders 38 on the remote ends thereof. To receive the shoulders 38 a circumferential recess 40 is provided in the internal wall of the housing near the rear end thereof.

The configuration and dimensions of the recess 40 and the shoulders 38 are such that on insertion of the plug 34 into the rear end of the housing, the legs 36 flex together to pass into the housing and then snap outwardly into the recess. The periphery of the exposed portion of the plug has the same size and shape as the rear end of the housing, so that after such assembly, there is no laterally protruding portion of the plug to push against to force the plug out of the housing.

Although it would be possible to increase the locking effect of the shoulders 38 in the recess 40 by providing a radial abutment on the rear of the shoulders and on the adjacent side of the recess 40, such a recess configuration would be difficult to mold.

Therefore, to provide means for securely locking the plug in the housing, the legs 36 are shaped and dimensioned to provide a central cavity 42, and the cavity 42 and the extreme stud end 27 are so dimensioned that when the seal is closed, the stud end 27 completely fills the portion of the aperture between the ends of the legs 36 thereby preventing the legs from flexing inwardly. Attempts to remove the plug by inserting a knife or the like between the plug and socket by grasping the plug with pliers and pulling will not succeed, since for the plug to move out of the housing, the arms must flex inwardly, and this is prevented by the presence of the stud end 27 between the legs.

Although the plug 34 may be molded separately and then assembled into the housing, it is preferred to mold the plug as an integral part of the seal, connected thereto by a flexible hinge or web 44. For convenience in molding, the plug 34 may be molded alongside the housing, with the axis of the plug parallel to the axis of the housing, so that in the molding process a core pin (not shown) forming the cavity 42 in the plug is withdrawn in the same motion as the core pin forming the cavity 20 in the housing. The length of the hinge 44 is sufficient to allow the plug to be swung around 180° to enter the rear end of the socket without the necessity of cutting the hinge.

Although in the illustrated embodiment, the invention is shown as being applied to a one-piece plastic seal of the type disclosed in the above-identified co-pending application of Sigurd M. Moberg, it will be understood that the inventive concept disclosed herein may be applied to seals of other configurations without departing from the scope of the invention.

Since certain changes obvious to one skilled in the art may be made in the herein disclosed embodiment of the invention, it is intended that all matter contained herein be interpreted in an illustrative and not a limiting sense.

I claim:

1. A seal comprising housing open at both ends and a shackle, said housing and a shackle end having means for locking engagement when the shackle end is inserted into one end of the housing, and means for closing the other end of the housing, comprising a plug having a base for covering said other end and resilient legs for extending into said other end, and means in the housing engaging said legs and preventing withdrawal thereof.

2. A seal as set out in claim 1 in which said plug is molded integrally with the housing and is joined thereto by a flexible web having a length sufficient to allow the plug to be inserted into the housing without breaking the web.

3. A seal as set out in claim 2 in which the axis of the plug in the as molded condition is parallel to the axis of the housing.

4. A seal formed of resilient moldable plastic comprising a hollow housing open at both ends and a shackle having a free end insertable into the housing, said shackle and said housing having cooperating means for locking engagement, the other end of the housing being open when in the as molded condition, said housing having an internal recess spaced inwardly from said end, and a plug closing said other end of the housing, said plug having resilient fingers extending into the housing with external shoulders seated in said recess, said resilient fingers forming a central cavity therebetween, the extreme end of said shackle extending into said central cavity when the shackle end is assembled into locking engagement with the housing and being sized to prevent inward flexing of the legs to prevent release of the shoulders from the recess and thereby prevent removal of the plug from the housing.

5. A seal as set out in claim 4 in which the plug is molded integrally with the housing and is joined thereto by a flexible hinge web having a length sufficient to allow the plug to be inserted into the housing without breaking the web.

6. A seal as set out in claim 5 in which the axis of the plug in the as molded condition is parallel to the axis of the housing.

7. A seal formed of resilient moldable plastic comprising a hollow housing open at both ends in the as molded condition, and a shackle attached to the housing at one end and having a free end for insertion into one end of the housing, said shackle having an enlarged head spaced from said free end and said housing having internal resilient fingers near one end, said enlarged head and said fingers being positioned and dimensioned for locking engagement when the free end of the shackle is inserted into said one end of the housing, and a plug for closing the other end of the housing, said plug having a base conforming to the size and shape of the said other end of the housing and resilient legs extending from the base for extending into the housing when the plug is assembled therein, said legs having radially projecting shoulders and said housing having a recess in the internal wall positioned to receive said shoulders when the plug is assembled into the housing, said legs forming a central cavity therebetween opening toward said one end of the housing, the extreme end portion of said shackle beyond the enlarged head being dimensioned to project into said cavity when the seal is closed and prevent inward flexing of said legs and thereby prevent removal of the plug from the housing.

* * * * *